United States Patent [19]

Grossi

[11] Patent Number: 4,671,426

[45] Date of Patent: Jun. 9, 1987

[54] AUTOMATIC ARTICLE DISPENSER USING SCREW-DRIVEN MOBILE TRAYS

[76] Inventor: Lucio Grossi, Via Sylva 30, Bergamo, Italy

[21] Appl. No.: 754,846

[22] Filed: Jul. 12, 1985

[30] Foreign Application Priority Data

Jul. 13, 1984 [IT] Italy ..... 21881 A/84

[51] Int. Cl.[4] ..... G07F 11/00

[52] U.S. Cl. ..... 221/75; 221/69; 221/82; 221/312 R

[58] Field of Search ..... 221/69, 75, 76, 82, 221/87, 312 R

[56] References Cited

U.S. PATENT DOCUMENTS 1,698,644 1/1929 McCutchen ..... 221/82

3,194,432 7/1965 Breitenstein et al. ..... 221/82

4,180,182 12/1979 Fish et al. ..... 221/75

FOREIGN PATENT DOCUMENTS 0710935 6/1931 France .

*Primary Examiner*—Robert J. Spar

*Assistant Examiner*—Jay I. Alexander

*Attorney, Agent, or Firm*—Karl F. Ross; Herbert Dubno

[57] ABSTRACT

An automatic dispenser in which a vertically elongated housing has a screw at a rear end thereof whose lower portion is free from a screwthread. Fork-shaped rear edges of trays carrying articles to be dispensed are lowered by rotation of the motor-driven screw until they reach the thread-free portion whereupon the tray is dropped to the bottom of the housing at which an access opening is provided and to allow articles on the trays to be removed while the trays accumulate at the bottom of the housing.

5 Claims, 2 Drawing Figures

AUTOMATIC ARTICLE DISPENSER USING SCREW-DRIVEN MOBILE TRAYS

FIELD OF THE INVENTION

The present invention relates to an automatic article dispenser having mobile trays which are displaced by a screw to an access opening.

BACKGROUND OF THE INVENTION

There are available, for different applications, automatic item, article or goods dispensers which store a large number of items in an ordered manner so that they may be supplied one at a time to a retrieval point on the introduction of a predetermined sum of money or a token into an automatic vending machine.

Various mechanisms have been designed for this purpose; such mechanisms for example exploit gravity or forced feed of vertically stacked objects. This allows for very compact machines but requires objects of uniform shape and constant dimensions. There also exist dispensers based on screw conveyors or having mobile compartments mounted on a wheel; these, however, are very bulky and take up considerable space, particularly in depth, relative to the number of items to be stored. This renders them quite unsuitable in situations where there are restrictions on space and, furthermore, they have the disadvantage of being of fixed size and devoid of the flexibility which would permit them to adapt to different dimensions of the stored items and thus maximize capacity.

French Pat. No. FR-A-710,935 describes a dispenser having a shaft on which a plurality of supporting elements are inserted, starting from its upper part, such supporting elements being spaced from each other by the thickness of their hub and carrying the items to be dispensed. The shaft has a screw portion which engages in an internal thread of the hubs, to support and space apart the supporting elements in the retrieval area.

This structure allows storage of the items to be dispensed in a small volume but is of complex construction, requires supporting elements having a particularly designed hub, which is difficult to manufacture, and has problems of reliability with respect to the engagement of a supporting element with the threaded part of the shaft; the maximum height of the items to be stored is moreover limited by the thickness of the hub, which is constant for all the supporting elements and cannot be adapted to items having different heights.

OBJECT OF THE INVENTION

It is therefore the object of this invention to provide an automatic dispenser of reduced volume, in particular of reduced depth, which can contain a large quantity of items, adapted to the bulk of the items themselves without imposing limits on their dimensions or fragility and without damaging them.

SUMMARY OF THE INVENTION

These requirements are satisfied, according to this invention, by an automatic item dispenser which comprises an enclosure containing a vertically aligned screw shaft, on the thread of which rests the shaped edge of a plurality of trays, which carry the items to be dispensed, a drive motor connected to the shaft, to cause the screw to rotate providing a vertical displacement of the trays from a storage or accumulation point of the filled trays to a supply or retrieval point (access opening). Corresponding to this retrieval point, the enclosure which contains the screw shaft and trays has an opening, possibly fitted with some sort of door or cover, for access to the dispensed items. The apparatus is fitted with a coin-operated device for the activation of the drive motor on payment of the predetermined sum and with sensors which detect the position of the trays and thus control the rotation of the screw and enable the opening of the access door or cover in relation to the position of the trays.

The dispenser enclosure is fitted with a key or similarly operated aperture which allows the dispensed items to be replaced while the apparatus is disabled or in operation.

More particularly, the dispenser has a vertically aligned screw shaft which is free to rotate, located in the rear section of a rectangular shaped enclosure and driven by a motor.

The items to be dispensed are supported by metal trays which have fork-shaped rear edges inserted on the screw shaft, supporting them in a horizontal position; the rotation of the screw causes the trays to shift downwards, the rotation of the trays being prevented by the wall panels of the enclosure. The lower section of the enclosure constitutes a retrieval area fitted with an access aperture, the thread on the screw shaft terminates opposite this retrieval area at the bottom of the housing at which a storage area for the empty trays is provided.

Conveniently a plurality of similar dispensers can be placed side by side, thus forming a multiunit dispensing apparatus. In order to prevent vandalism and damage to the dispensing apparatus, blocking means can be connected to the enclosure of the dispenser to engage the trays and to prevent the unallowed removal of the trays.

The implementation of a dispenser according to the invention allows for a minimal space requirement which is slightly greater than the base dimensions of the largest item to be dispensed; the number of items contained and their height determine the vertical dimensions of the dispenser which usually does not suffer severe restrictions, admitting the possible extension to more than one floor and with one end of the apparatus suitable for reloading. This reloading operation may also occur during operation of the dispenser.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
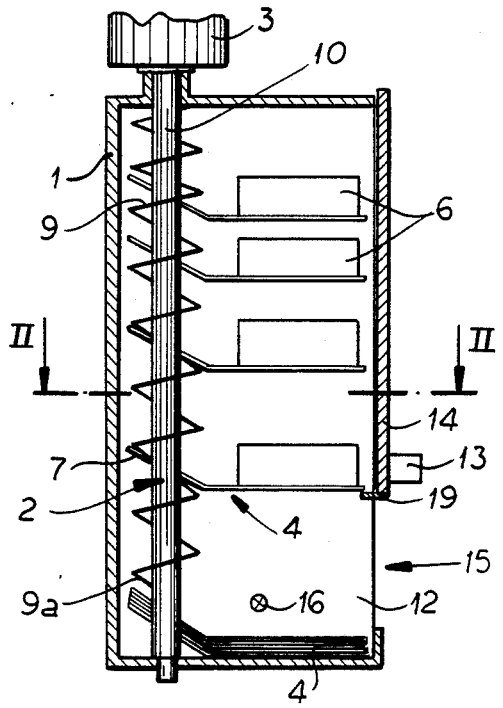
FIG. 1 is a longitudinal cross-section taken along the line I—I of FIG. 2.
Figure 2:
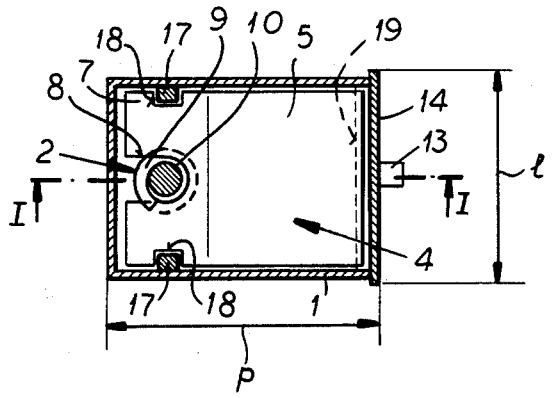
FIG. 2 is a section along the line II—II of FIG. 1.

FIG. 1 shows, in cross section, an automatic dispenser according to the invention, which consists of an enclosure 1, within which is a screw shaft 2 driven by a motor 3. On the screw shaft 2 are inserted a number of trays 4, each of which has a flat portion 5 on which are carried the items 6 for automatic vending, and an angled portion 7 with slot 8 shaped as a fork so as to fit onto screw shaft 2, as illustrated in FIG. 2. In this manner the screw thread 9 maintains the flat portion 5 of tray 4 in a horizontal position while the main body of the shaft itself guides the movement of the trays.

The counter-clockwise rotation of screw shaft 2, with right hand thread as shown, is produced by motor 3 and activated by a coin-operated device which is not illustrated. The rotation causes a downward displacement of the trays 4, their rotation being prevented by the side wall panels of the enclosure 1, until the lowermost tray frees itself from the extremity 9*a* of the thread 9 and slides down along the thread-free end of the screw shaft 10 to the bottom of a retrieval area 12 within enclosure 1, while a sensor 13 of electromechanical, optical, magnetic or similar type, having detected the passage of a tray 4, causes the motor 3 to be deactivated after a sufficient number of shaft rotations has assured that the tray 4, has in fact, dropped off the thread 9 of the screw 2.

The front wall 14 has an access opening or aperture 15 corresponding to the area 12 so that the purchased item 6 may be removed while the empty trays 4 accumulate at the bottom of area 12.

A sensor 16, for example of the optical type, may be present in the area 12 to prevent further activation of the dispenser until the requested item 6 has been removed from the area 12, thus freeing this area for the next tray 4 and its respective carried item, thereby preventing jamming caused by improper use. When all the items 6 have been removed and all the trays 4 have accumulated at the bottom of the area 12, an operator may open the front wall panel 14, remove the trays 4 from said area 12 to insert them once more on the screw shaft 2 and restock the items 6. To prevent unauthorized removal of trays 4 along with the items 6, the area 12 may be fitted with blocking means for the trays which may be disabled on opening the dispenser for restocking or, in general, can prevent the removing of the trays if the dispenser has not been opened. An example for such means is the projecting elements 17, protruding from the walls of the enclosure 1, which engages in the recess 18 of the trays.

As may be seen from FIG. 2, the dispenser presents the minimum of bulk, its width "1" being practically equal to the width of tray 4 plus the thicknesses of the wall panels of enclosure 1, while its depth "p" is equal to the useful depth of tray 4 plus the diameter of screw shaft 2 plus the thicknesses of the front and rear wall panels 14. It is thus possible to install a number of such dispensers side by side with base area dimensions practically equal to or slightly larger than the dimensions of the items stored, while the height and maximum number of items, corresponding to maximum storage capacity of each dispenser, determine the overall height.

The screw shaft 2 can be composed by a cylindrical central bar, or shaft 10, supported at its extremities and driven at one end by a motor. The thread may be composed of a length of metal of rectangular or circular cross-section helicoidally wound onto the central bar with the required pitch, fixed to the central bar by means of, for example, welded joints at its extremities and driven at one end by a motor. The thread may be composed of a length of metal of rectangular or circular cross-section helicoidally wound onto the central bar with the required pitch, fixed to the central bar by means of, for example, welded joints at its extremities; of course it is possible to obtain more precisely manufactured screws by machining, thus satisfying specific thread profile requirements.

As may be seen in the drawings, the vertical distance between successive trays or containers may be freely chosen and can be different for each stored item, for instance in case of dispensing of irregularly shaped or irregularly packed items, in order to allow an easy loading, without compulsory dimensions and at the same time allowing the maximum exploitation of available space.

The front edge of the lowermost of the trays carrying an object 6 rests against a small tooth 19, and the tray cannot be deflected downwardly, so causing the theft to be impossible. When the screw 2 is operated, the portion 7 of the tray is lowered, tilting the tray 5 rearwardly, as far as the tray slips away from the small tooth 19; the tray can consequently return to a horizontal position and drop to the bottom of the retrieval area 12, in order to allow the object to be taken off.

I claim:

1. An automatic dispenser, comprising:

a vertically elongated housing having a rectangular horizontal section and formed with a front wall having an access opening at a bottom of said housing, a rear wall opposite said front wall, and side walls connecting said front and rear walls;

a vertically disposed screw in said housing at a rear thereof proximal to said rear wall and formed with a vertical shaft extending the full height of said housing, a screwthread formed over all of the length of said shaft in said housing above said access opening, and a thread-free portion formed on said shaft only below said screwthread and opposite said access opening at said bottom;

a plurality of trays, each having a forked rear edge engageable with said screwthread and supported exclusively thereby at the region of the screwthread engaged by the respective rear edge while carrying an article and vertically displaceable downwardly by rotation of said screwthread from locations above said access opening at which said articles are stored into the region of said access opening at which an article can be retrieved from a respective tray through said access opening, said trays being prevented from rotation by said walls which flank said plurality of trays, said bottom of said housing forming a compartment wherein trays dropped from said screwthread at said thread-free portion are stored; and a motor on said housing for driving said shaft and provided with means for terminating rotation of said shaft following rotation sufficient to cause said screwthread to displace said trays sufficiently to cause one of said trays with an article thereon to drop off said screwthread over said thread-free portion.

2. The automatic dispenser defined in claim 1 wherein one of said walls is provided with means enabling it to be opened over the length of said screwthread to permit repositioning of said trays on said screwthread and restocking of said trays with said articles.

3. The automatic dispenser defined in claim 1, further comprising blocking means in said housing preventing removal of said trays therefrom through said access opening.

4. The automatic dispenser defined in claim 3 wherein said blocking means includes respective bars on said side walls engageable in respective notches of said trays.

5. The automatic dispenser defined in claim 1, further comprising a tooth formed on said front wall at an upper edge of said access opening and adapted to support a lowermost tray carried by said screwthread until rotation of said screw causes upward deflection of a front edge of said lowermost tray to enable said lowermost tray to clear said tooth.

* * * * *